US008733108B2

(12) United States Patent
Kim et al.

(10) Patent No.: US 8,733,108 B2
(45) Date of Patent: May 27, 2014

(54) COMBUSTOR AND COMBUSTOR SCREECH MITIGATION METHODS

(75) Inventors: Kwanwoo Kim, Greer, SC (US); Thomas Edward Johnson, Greenville, SC (US); Jong Ho Uhm, Simpsonville, SC (US); Gilbert Otto Kraemer, Greer, SC (US)

(73) Assignee: General Electric Company, Schenectady, NY (US)

( * ) Notice: Subject to any disclaimer, the term of this patent is extended or adjusted under 35 U.S.C. 154(b) by 991 days.

(21) Appl. No.: 12/833,237

(22) Filed: Jul. 9, 2010

(65) Prior Publication Data

US 2012/0006033 A1 Jan. 12, 2012

(51) Int. Cl.
*F02C 1/00* (2006.01)
*F02C 7/22* (2006.01)

(52) U.S. Cl.
USPC ..... 60/776; 60/737; 60/740; 60/725

(58) Field of Classification Search
USPC ..... 60/724, 725, 733, 739, 740, 742, 746, 60/747, 749, 39.77, 752, 737, 776
See application file for complete search history.

(56) References Cited

U.S. PATENT DOCUMENTS

| | | | | |
|---|---|---|---|---|
| 5,125,227 | A * | 6/1992 | Ford et al. | 60/39.23 |
| 5,235,814 | A * | 8/1993 | Leonard | 60/738 |
| 5,321,949 | A * | 6/1994 | Napoli et al. | 60/739 |
| 5,836,164 | A * | 11/1998 | Tsukahara et al. | 60/733 |
| 5,927,076 | A * | 7/1999 | Pillsbury | 60/738 |
| 5,943,866 | A * | 8/1999 | Lovett et al. | 60/737 |
| 6,164,055 | A * | 12/2000 | Lovett et al. | 60/776 |
| 6,282,886 | B1 * | 9/2001 | Sato et al. | 60/39.37 |
| 6,327,861 | B2 * | 12/2001 | Sato et al. | 60/746 |
| 6,889,495 | B2 * | 5/2005 | Hayashi et al. | 60/39.37 |
| 7,578,130 | B1 | 8/2009 | Kraemer et al. | |
| 7,631,499 | B2 | 12/2009 | Bland | |
| 2003/0167771 | A1 * | 9/2003 | Hayashi et al. | 60/737 |
| 2004/0045297 | A1 * | 3/2004 | Inoue et al. | 60/740 |
| 2008/0173019 | A1 * | 7/2008 | Kobayashi et al. | 60/739 |
| 2011/0314824 | A1 * | 12/2011 | Cheung | 60/737 |

OTHER PUBLICATIONS

U.S. Appl. No. 12/358,805, filed Jan. 23, 2009, Lacy, et al.

* cited by examiner

*Primary Examiner* — Phutthiwat Wongwian
*Assistant Examiner* — Michael B Mantyla
(74) *Attorney, Agent, or Firm* — Sutherland Asbill & Brennan LLP

(57) ABSTRACT

The present application provides for a combustor for use with a gas turbine engine. The combustor may include a cap member and a number of fuel nozzles extending through the cap member. One or more of the fuel nozzles may be provided in a non-flush position with respect to the cap member.

6 Claims, 2 Drawing Sheets

COMBUSTOR AND COMBUSTOR SCREECH MITIGATION METHODS

FEDERAL RESEARCH STATEMENT

This invention was made with Government support under Contract No. DE-FC26-05NT42643, awarded by the US Department of Energy (DOE). The Government has certain rights in this invention.

TECHNICAL FIELD

The present application relates generally to gas turbine engines and more particularly relates to a combustor with variably positioned nozzles therein so as to provide screech and other types of combustion dynamics mitigation.

BACKGROUND OF THE INVENTION

In general, gas turbine engines combust a fuel-air mixture to form a high temperature combustion gas stream. The high temperature combustion gas stream is channeled to a turbine via a hot gas path. The turbine converts the thermal energy from the high temperature combustion gas stream to mechanical energy so as to rotate a turbine shaft. The gas turbine engine may be used in a variety of applications, such as for providing power to a pump or an electrical generator and the like.

Operational efficiency generally increases as the temperature of the combustion gas stream increases. Higher gas stream temperatures, however, may produce higher levels of nitrogen oxide ($NO_x$), an emission that is subject to both federal and state regulation in the U.S. and subject to similar types of regulation abroad. A balance thus exists between operating the gas turbine in an efficient temperature range while also ensuring that the output of $NO_x$ and other types of emissions remain below the mandated levels.

The fuel-air mixture may be combusted in a combustor via a number of mini-tube bundle nozzles. These mini-tube bundle nozzles or other types of combustion nozzles may be utilized so as to reduce emissions and also to permit the use of highly reactive types of syngas and other fuels.

High hydrogen fuel combustion, however, may excite frequencies higher than about a kilohertz or more as well as longitudinal acoustic modes in combustors configured with the mini-tube bundle nozzles or other types of combustion nozzles. The screech and other types of combustion dynamics may occur through the combustion interaction between adjacent nozzles and the coupling of the combustion processes and geometry. The combustion dynamics may cause mechanical fatigue even at low amplitude and may lead to hardware damage at higher amplitudes.

There is a therefore for a desire for an improved combustor that avoids or at least mitigates against advanced combustion dynamics. Such a combustor should avoid such combustion dynamics while maintaining highly efficient operation with minimal emissions.

SUMMARY OF THE INVENTION

The present application thus provides for a combustor for use with a gas turbine engine. The combustor may include a cap member and a number of fuel nozzles extending through the cap member. One or more of the fuel nozzles may be provided in a non-flush position with respect to the cap member.

The present application further provides for a method of mitigating combustion dynamics in a combustor of a gas turbine engine. The method may include the steps of positioning a number of fuel nozzles in a cap member of the combustor, varying the position of the fuel nozzles with respect to the cap member, and operating the combustor to determine the combustion dynamics produced by the fuel nozzles in the varying positions.

The present application further provides a combustor for use with a gas turbine engine. The combustor may include a cap member and a number of fuel nozzles extending through the cap member. One or more of the fuel nozzles may be provided in a recessed position or a protruding position with respect to the cap member.

These and other features and improvements of the present application will become apparent to one of ordinary skill in the art upon review of the following detailed description when taken in conjunction with the several drawings and the appended claims.

DETAILED DESCRIPTION

Figure 1:
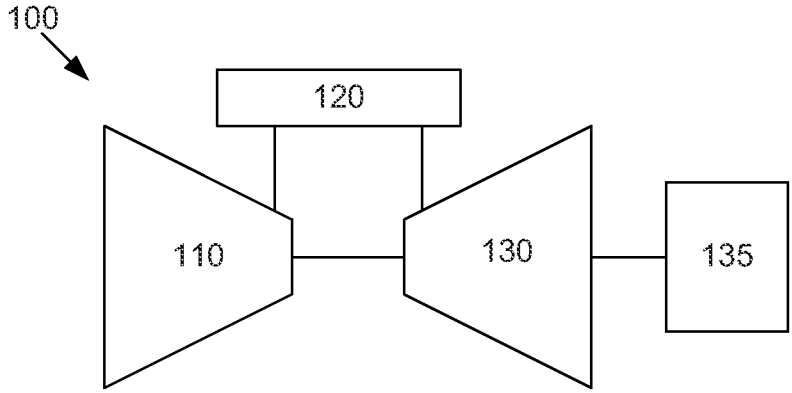
FIG. 1 is a schematic view of a gas turbine engine that may be used with the combustor described herein.

Referring now to the drawings, in which like numbers refer to like elements through out the several views, FIG. 1 shows a schematic view of a gas turbine engine 100. As is described above, the gas turbine engine 100 may include a compressor 110 to compress an incoming flow of air. The compressor 110 delivers the compressed flow of air to a combustor 120. The combustor 120 mixes the compressed flow of air with a compressed flow of fuel and ignites the mixture. Although only a single combustor 120 is shown, the gas turbine engine 100 may include any number of combustors 120. The hot combustion gases are in turn delivered to a turbine 130. The hot combustion gases drive the turbine 130 so as to produce mechanical work. The mechanical work produced in the turbine 130 drives the compressor 110 and an external load 135 such as an electrical generator and the like.

The gas turbine engine 100 may use natural gas, various types of syngas, and other types of fuels. The gas turbine engine 100 may be a 9FBA heavy duty gas turbine engine offered by General Electric Company of Schenectady, N.Y. The gas turbine engine 100 may have other configurations and may use other types of components. Other types of gas turbine engines also may be used herein. Multiple gas turbine engines 100, other types of turbines, and other types of power generation equipment may be used herein together.

Figure 2:
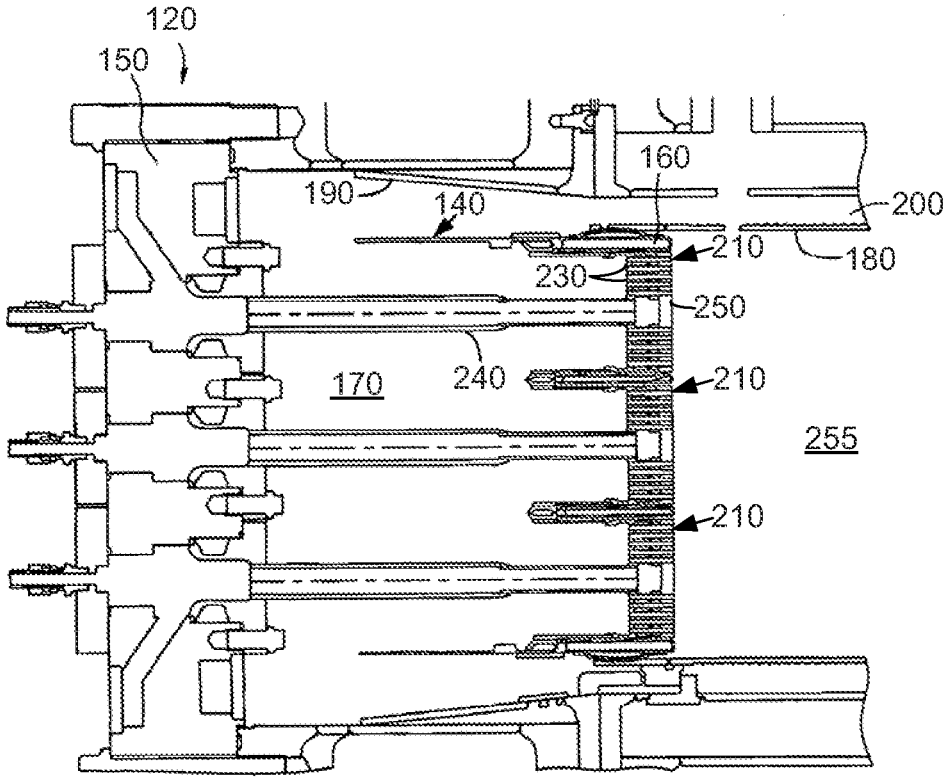
FIG. 2 is a side cross-sectional view of a combustor with a number of mini-tube fuel injection nozzles.
Figure 3:
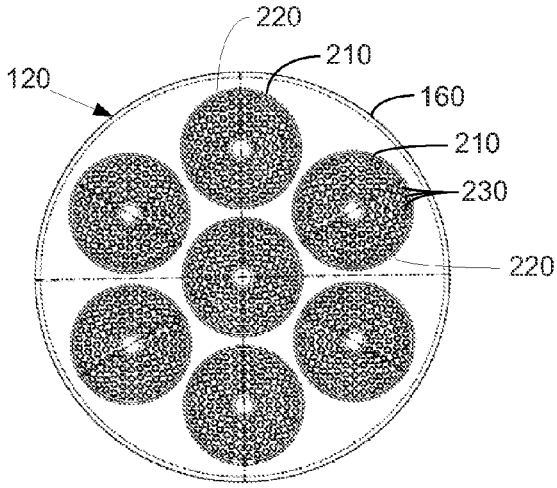
FIG. 3 is a front plan view of the combustor of FIG. 2.

FIGS. 2 and 3 show an example of the combustor 120. The combustor 120 may include a cap barrel 140 that extends from an end cover 150 positioned at a first end thereof to a cap member 160 at an opposite end thereof. The cap member 160 may be spaced from the end cover 150 so as to define an interior flow path 170 for a flow of the compressed air through the cap barrel 140 and the cap member 160. The combustor 120 further may include a combustor liner 180 and a flow sleeve 190 positioned upstream of the cap barrel 140. The combustor liner 180 and the flow sleeve 190 may define a cooling flow path 200 therethrough in reverse flow communication with the interior flow path 170.

A number of fuel nozzles 210 may be positioned within the cap member 160. Any number of fuel nozzles 210 may be used herein. The fuel nozzles 210 may be attachably mounted within a number of openings 220 through the cap member 160. In this example, each fuel nozzle 210 may include a bundle of mini-tubes 230. Each mini-tube 230 may be in communication with a flow of fuel via a fuel path 240 and a central fuel plenum 250. Any number of mini-tubes 230 may be used herein. Other types of nozzles and nozzle configurations also may be used herein.

Air from the compressor 110 thus flows through the cooling flow path 200 between the combustor liner 180 and the flow sleeve 190 and then reverses into the cap barrel 140. The air then flows through the interior flow path 170 defined between the end cover 150 and the cap member 160. The air passes about the mini-tubes 230 of each fuel nozzle 210 so as to be mixed with a flow of fuel from each mini-tube 230. The flow of fuel and the flow of air then may be ignited downstream of the cap member 160 in a combustion zone 255. The combustor 120 herein is shown by way of example only. Many other types of combustor designs and combustion methods may be used herein.

Figure 4:
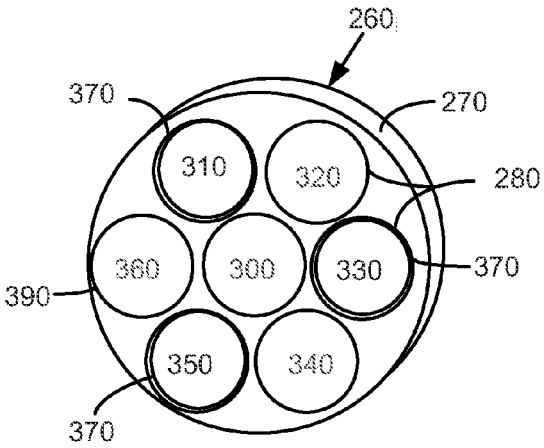
FIG. 4 is a partial perspective view of a combustor with a cap member as may be described herein.
Figure 5:
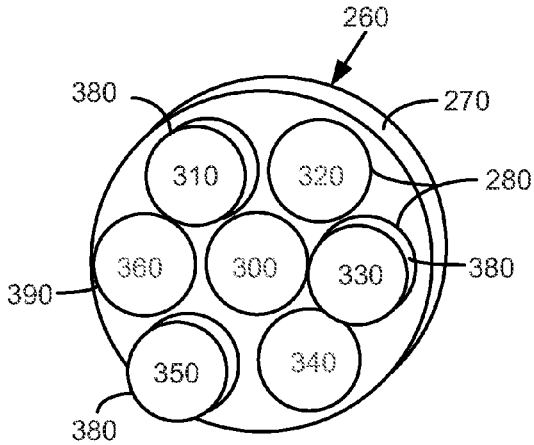
FIG. 5 is a further partial perspective view of the combustor with a cap member of FIG. 4.

FIGS. 4 and 5 show portions of a combustor 260 as may be described herein. Similar to the combustor 120 described above, the combustor 260 includes a cap member 270 with a number of fuel nozzles 280 positioned therethrough. Each of the fuel nozzles 280 may have a bundle of the mini-tubes 230 therein. Other types of nozzles 280 and nozzle configurations also may be used herein. In this example, a central nozzle 300 may be surrounded by six outer nozzles 310, 320, 330, 340, 350, 360. Any number of fuel nozzles 280 and mini-tubes 230 may be used herein in any position and/or orientation.

In the example of FIG. 4, the first outer nozzle 310, the third outer nozzle 330, and the fifth outer nozzle 350 include a recessed position 370 as compared to the face of the cap member 270. In the example of FIG. 5, the first outer nozzle 310, the third outer nozzle 330, and the fifth outer nozzle 350 include a protruding position 380 as compared to the face of the cap member 270. The remaining fuel nozzles 280 may include a substantially flush position 390 relative to the cap member 270 in a manner similar to that described above. Any of the fuel nozzles 280 may have the recessed position 370, the protruding position 380, or the flush position 390. Likewise, any combination of the fuel nozzles 280 may be used in the recessed position 370, the protruding position 380, and/or the flush position 390 as may be desired. Both the recessed position 370 and the protruding position 380 may be referred to a "non-flush position".

Although the fuel nozzles 280 have been discussed as being positioned with respect to the cap member 270, the use of the cap member may not be required. Rather, the fuel nozzles 280 may be positioned about an imaginary plane across the flush position 370 and the like. In other words, the flush position 370 may be even with the plane with the recessed position 370 and the protruding position 380 configured accordingly.

The screech and other types of combustion dynamics of each individual combustor 260 thus may vary according to a number of construction variables, operational variables, and other variable such that each combustor 260 may use different combinations of fuel nozzles 280 in the recessed position 370, the protruding position 380, and/or the flush position 390. These different nozzle positions may combine so to reduce combustion dynamics and improve overall combustor performance, both individually and as a combination of combustors in a gas turbine engine 100 as a whole.

The use of the fuel nozzles 280 in the recessed position 370, the protruding position 380, and/or the flush position 390 with respect to the cap member 270 and/or each other thus may mitigate or avoid combustion dynamics by the decoupling of at least the interaction between adjacent fuel nozzles 280. This positioning thus should improve the overall operability, durability, and reliability of the fuel nozzles 280 and the overall combustor 260. The acoustic dynamics thus may be significantly modified so as to change the interaction of the pressure and the heat released about the nozzles 280 and the combustion dynamics caused thereby.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A gas turbine engine, comprising:

a combustor, comprising:

a cap member comprising an aft surface;

a plurality of fuel nozzles extending at least partially through the cap member;

a distal end of one or more of the plurality of fuel nozzles being substantially upstream from the aft surface of the cap member;

a distal end of one or more of the plurality of fuel nozzles being substantially downstream from the aft surface of the cap member; and a distal end of one or more of the plurality of fuel nozzles being substantially flush with the aft surface of the cap member.

2. The combustor of claim 1, wherein the plurality of fuel nozzles each comprise a plurality of mini-tubes therein.

3. The combustor of claim 1, wherein one or more of the plurality of nozzles further are provided in a substantially flush position with respect to each other.

4. The combustor of claim 1, wherein the plurality of nozzles comprises a central nozzle and a plurality of outer nozzles.

5. A method of mitigating combustion dynamics in a gas turbine engine, comprising:

positioning a plurality of fuel nozzles at least partially through a cap member of a combustor, wherein the cap member comprises an aft surface;

positioning a distal end of one or more of the plurality of fuel nozzles substantially upstream from the aft surface of the cap member;

positioning a distal end of one or more of the plurality of fuel nozzles substantially downstream from the aft surface of the cap member;

positioning a distal end of one or more of the plurality of fuel nozzles substantially flush with the aft surface of the cap member; and operating the combustor to determine the combustion dynamics produced by the plurality of fuel nozzles in the varying positions.

6. The method of claim 5, further comprising determining the position of the plurality of fuel nozzles to minimize the production of combustion dynamics.

* * * * *